United States Patent [19]

Yanagisawa et al.

[11] 4,450,327

[45] May 22, 1984

[54] VACUUM INTERRUPTER

[75] Inventors: Hifumi Yanagisawa, Sagamihara; Junichi Warabi, Shizuoka; Yoshiyuki Kashiwagi, Tokyo, all of Japan

[73] Assignee: Kabushiki Kaisha Meidensha, Tokyo, Japan

[21] Appl. No.: 283,866

[22] Filed: Jul. 16, 1981

[30] Foreign Application Priority Data

Jul. 21, 1980 [JP] Japan ..... 55-99693

[51] Int. Cl.[3] ..... H01H 33/00

[52] U.S. Cl. ..... 200/144 B; 200/148 B

[58] Field of Search ..... 200/144 B, 148 B

[56] References Cited

U.S. PATENT DOCUMENTS

| | | | |
|---|---|---|---|
| 2,906,841 | 9/1959 | Jennings | 200/144 B |
| 3,674,958 | 7/1972 | Attia et al. | 200/144 B |
| 3,727,018 | 4/1973 | Wesoloski et al. | 200/144 B |
| 3,812,314 | 5/1974 | Nonken | 200/144 B |
| 4,077,114 | 3/1978 | Sakuma | 29/622 |

FOREIGN PATENT DOCUMENTS 1298448 12/1972 United Kingdom .

2010587A 6/1979 United Kingdom .

*Primary Examiner*—E. A. Goldberg
*Assistant Examiner*—Morris Ginsburg
*Attorney, Agent, or Firm*—Pollock, VandeSande & Priddy

[57] ABSTRACT

An evacuated envelope includes a cylindrical housing made of a metallic material, disc-shaped upper and lower end plates made of ceramic and stationary and movable contact rods. The envelope of the vacuum interrupter is manufactured by brazing the end plates to the housing by using a sealing member made of a hermetically deformable metallic material which deforms by thermal stress generated during a cooling process after hermetic brazing. Sealing means of the envelope is provided with surface-to-surface sealing between the seal member and the cylindrical metallic housing or the disc-shaped end plate in order to enhance the sealing performance. The envelope is hermetically sealed by deforming the sealing member after brazing the sealing member to the housing in order to further enhance the sealing performance. The sealing member further comprises a stress absorbing means provided with a curved portion for absorbing thermal and mechanical stress.

17 Claims, 7 Drawing Figures

VACUUM INTERRUPTER

FIELD OF THE INVENTION

The present invention relates to a vacuum interrupter and, more particularly, a vacuum interrupter manufactured by using a suitable metallic sealing material.

BACKGROUND OF THE INVENTION

Vacuum circuit interrupters are, generally, constructed of a highly evacuated envelope, a stationary electrical contact provided in the envelope, a movable electrical contact provided in the envelope so as to be opposite to the stationary electrical contact and shields. The envelope comprises, substantially, a tubular housing and a pair of end plates. The housing is, generally, fabricated by a cylindrical insulating material, and a pair of metallic end plates used to form the evacuated envelope.

Moreover, the vacuum interrupter is, generally, constructed by the steps of fixing an upper and a lower end plate to each axial end of a cylindrical insulating housing respectively, mounting a bellows on the lower end plate, inserting a movable contact rod into the bellows, securing a movable electrical contact on the movable contact rod, and incorporating a stationary contact rod (secured a stationary electrical contact at the bottom thereof) to the upper end plate.

In this conventional vacuum interrupter it is difficult to make a diameter of the envelope large because the envelope is very expensive when a large diameter housing made of glass or ceramics is used as a part of the envelope. Further, a material made of an alloy Fe-Ni-Co or an alloy of Fe-Ni is usually employed in a vacuum-tight seal. This vacuum-tight seal is also very expensive and has a magnetic property. The vacuum interrupter, therefore, becomes very expensive and is low in reliability because the temperature thereof rises due to the eddy current generated by high current flow of the contact rods. Further, mechanical strength of the envelope is lower when a diameter of the housing is larger, and therefore the vacuum interrupter becomes low in reliability.

SUMMARY OF THE INVENTION

It is an object of the present invention to provide a highly reliable and high performance vacuum interrupter.

It is another object of the present invention to provide a vacuum interrupter of which a diameter can be easily and inexpensively made large in order to enhance the performance of the vacuum interrupter by constructing an envelope by employing a housing made of a metallic material, end plates made of insulating materials in the form of a ceramic or crystallized glass and auxiliary sealing members made of metallic materials which are plastically deformable due to the thermal stress at the high temperature and having stress releasing means.

In carrying out the present invention in one form, there is provided a vacuum interrupter and method of making the vacuum interrupter comprising an evacuated envelope including a cylindrical housing made of a metallic material and having hermetically brazed portions formed at the axial ends thereof and a disc-shaped upper end plate made of ceramics such as a high alumina ceramic or crystallized glass and having an aperture at the center thereof, a stationary electrical contact mounted on an end of a stationary contact rod inserted into said envelope through said aperture of said upper end plate, a movable contact rod inserted into the envelope through the aperture of said lower end plate, a bellows supporting said movable contact rod and made of a metallic material in the form of an austenitic stainless steel, having an upper end and a lower end. The lower end of said bellows is fixed to said lower end plate by means of a brazing material, shielding means for shielding the inner surface of the insulating portion of the envelope, and an auxiliary sealing member for aiding the brazing between the metallic portion and the insulating portion.

According to a second aspect of the present invention, therefore, there is provided a method of manufacturing a vacuum interrupter which comprises the steps of:

providing a cylindrical housing made of a metallic material in the form of an austenitic stainless steel, disposing a disc-shaped upper end plate having an aperture in the center thereof and a disc-shaped lower end plate by means of auxiliary sealing members which are made of Cu or Fe, being plastically deformable due to the thermal stress at high temperature, both of which are made of inorganic insulating materials at the respective axial ends of said housing to form an envelope, mounting a bellows of an austenitic stainless steel, having an upper end and a lower end, on the central portion of said lower end plate by means of said brazing material, supporting a movable contact rod of Cu, having an upper and a lower end, at the upper end of said bellows by means of said brazing material, mounting movable electrical contact made of an alloy including Cu on the upper end of said movable contact rod by means of said brazing material, inserting a stationary contact rod of Cu, having an upper and a lower end, in the aperture of said upper end plate by means of said brazing material, mounting a stationary electrical contact made of an alloy including Cu, at the lower end of said stationary contact rod by means of said brazing material. The temporary construction of the vacuum interrupter comprises the stationary portion, the movable portion and the housing portion and is heated at a temperature below the melting point of brazing materials for degassing in a high vacuum heating furnace. The furnace temperature is raised to a brazing temperature range between 900° C. and 1050° C. at a pressure less than $10^{-5}$ Torr in order to melt the brazing material and hermetically seal the brazing portion of the vacuum envelope of the vacuum interrupter.

According to a third aspect of the invention, therefore, there is provided a method of constructing a vacuum interrupter which comprises the steps of: supporting an upper end plate made of an inorganic insulating material and having an aperture in the center portion thereof horizontally, inserting a stationary contact rod made of Cu into said aperture of the upper end plate by means of brazing material, mounting a stationary electrical contact made of an alloy including Cu on an end of said stationary contact rod to form a stationary portion, disposing a lower end portion of a bellows made of an austenitic stainless steel on a lower end plate made of an inorganic insulating material, having an aperture in the center portion thereof, by means of a metallized portion and a brazing material, inserting a movable contact rod made of Cu into said bellows through said aperture of the lower end plate by means of a brazing material, disposing a movable electrical contact made of an alloy including Cu on an end portion of said movable contact rod to form a movable portion, providing a housing made of a metallic material, mounting a first auxiliary sealing member made of a metallic material which is plastically deformable by the thermal stress at a high temperature during the cooling process after brazing, mounting a second auxiliary sealing member made of a metallic material which is plastically deformable due to the thermal stress at a high temperature during the cooling process after brazing to form a housing portion. The temporary constructions comprising said stationary portion, the movable portion and the housing portion are heated respectively at a temperature below the melting point of brazing material for degassing in high vacuum heating furnace. The furnace temperature is raised to a brazing temperature range between 900° C. and 1050° C. at a pressure less than $10^{-5}$ torr in order to melt said brazing material and hermetically seal the brazing portion of the vacuum envelope of the vacuum interrupter, whereby the temporary constructed stationary portion, the movable portion and the housing portion is made respectively in the vacuum furnace. Thereafter the temperature of the furnace is decreased to a predetermined temperature for plastic deformation of the auxiliary sealing members and is held constant for a predetermined time interval. The temperature of the furnace is further decreased to the room temperature. The second step of brazing is further carried out in order to construct the vacuum interrupter. In the second step of brazing, the temporary construction is carried out by fitting the stationary portion and the movable portion to the housing portion. The temporarily assembled vacuum interrupter is heated at a temperature ranging from 500° C. to 1050° C. at a pressure less than $10^{-5}$ torr. Thereafter, the vacuum furnace is decreased to a predetermined temperature and is held constant for a predetermined time interval at the plastic deformation temperature. The temperature of the vacuum furnace is further decreased from said deformation temperature to the room temperature.

For a better understanding of the invention, reference may be had to the following description taken in conjunction with the accompanying drawings, wherein FIG. 1 is a partial cross sectional view through a vacuum interrupter embodying one form of the invention.

DETAILED DESCRIPTION OF THE PREFERRED EMBODIMENTS

Figure 1:
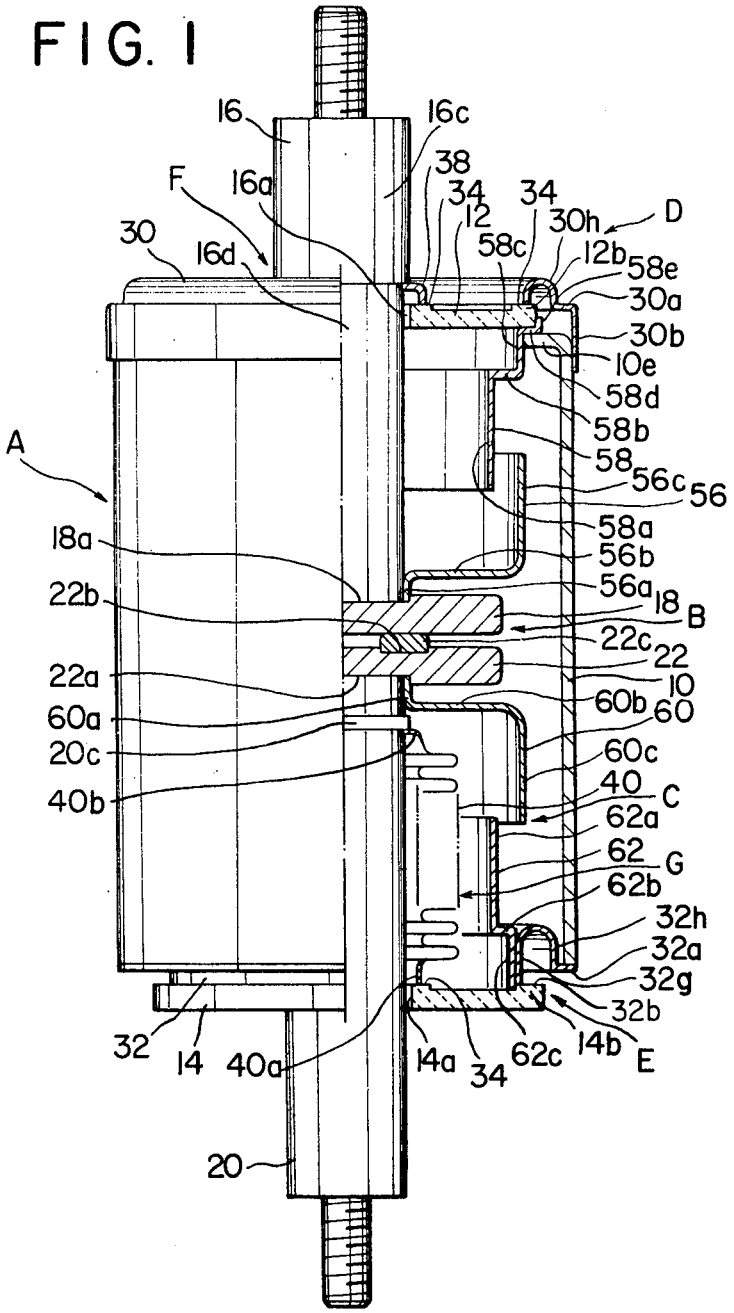

Referring to the drawing, particularly to FIG. 1, there is shown a first embodiment of a vacuum interrupter in accordance with the present invention. The vacuum interrupter of the invention comprises, substantially, an evacuated envelope A including a cylindrical housing 10 made of a non-magnetic material in the form of an austenitic stainless steel, an upper end plate 12 and a lower end plate 14, both of which are made of inorganic materials such as alumina ceramics or crystallized glass, an electrical contact member B including a stationary contact rod 16 supported by the upper end plate 12, a stationary electrical contact 18 secured to the stationary contact rod 16, a movable contact rod 20 secured to the lower end plate 14, a movable electrical contact 22 secured to the movable contact rod 20, and a shielding member C for shielding an internal surface of the end plates 12 and 14.

The vacuum interrupter of the invention further comprises first sealing means D for sealing hermetically the upper end plate 12 to the housing 10, second sealing means E for sealing hermetically the lower end plate 14, supporting means F for supporting and securing hermetically the stationary contact rod 16 to the upper end plate 12, and hermetic seal means G for sealing movably and hermetically the movable contact rod 20 to the lower end plate 14.

As is shown in FIG. 1, the upper end plate 12 is secured to a first end portion of the housing 10, and the lower end plate 14 is secured to a second end portion of the housing 10 to form the envelope A. In the electrical contact member B, the stationary electrical contact 18 has a circular recess 18*a* provided in the center portion thereof. An end portion of the stationary contact rod 16 is inserted and secured to the recess 18*a*. The movable electrical contact 22 is provided with a circular recess 22*a* in the center portion thereof and a ring-shaped slot 22*b* on the opposite surface to the stationary electrical contact 18. An end portion of the movable contact rod 20 is inserted and secured to the recess 22*a*, and an electrical contact ring 22*c* is disposed on the slot 22*b* to form the contact member B.

A first auxiliary sealing member 30 is fitted between the housing 10 and the upper end plate 12. A second auxiliary sealing member 32 is provided between the housing 10 and the lower end plate 14. The auxiliary sealing members are provided with at least one curved portion for absorbing the mechanical stress generated by activation of the interrupter or by the thermal stress during brazing. One end of the auxiliary sealing member is secured to the first end portion of the housing by means of brazing, and the other end of the auxiliary sealing member is fastened to the end plate.

In more detail, a cylindrical housing 10 is made of a non-magnetic metallic material such as an austenitic stainless steel of which the mechanical strength is relatively large. The housing 10 has a flange 10*e* curved toward the inside of the housing 10. A first auxiliary sealing member 30 comprises a flange portion 30*a*, a tubular portion 30*b* curved at right angles with respect to the flange portion 30*a*, and a curved portion 30*h* curved into a semi-circular shape. A first end portion of the housing 10 is inserted into the tubular portion 30*b* of the first auxiliary sealing member 30 to form a surface to surface sealing portion. One end of the curved portion 30*h* is secured to the end of a projection 12*b* provided on the rim of an upper end plate 12, sandwiching a metallized portion 34 therebetween. Accordingly, the first sealing means D comprises the first auxiliary sealing member 30 having: the flange portion 30*a*, the first tubular portion 30*b* extending at right angles and the semi-circular curved portion 30*h*, a first end portion of the housing 10 which is inserted into the tubular portion 30*b* of the first auxiliary sealing member 30, and the rim of the upper end plate 12 to which extends the end of the curved portion 30*h* of the first auxiliary sealing member 30. The second sealing means E comprises a second end portion of the housing 10, a second auxiliary sealing member 32 having a ring-shaped flange portion 32*a*, a tubular portion 32*b* having a diameter smaller than that of the flange portion 32*a*, and a curved portion 32*h* formed integrally with the flange portion 32*a* and the tubular portion 32*b*, and an end of a projection 14*b* which is secured to an end of the tubular portion 32*b* of the second auxiliary sealing member 32. A face of the second end portion of the housing 10 is secured to a surface of the flange portion 32*a* of the second sealing member 32 to form a surface-to-surface sealing portion. First supporting means F for supporting and securing hermetically a stationary contact rod 16 includes a cup-shaped third auxiliary sealing member 38 and a ring-shaped metallized portion 34 provided on an upper surface of the upper end plate 12. One end of the third auxiliary sealing member 38 is fixed to a lower rod portion 16*d* of the stationary contact rod 16. The other end of the auxiliary sealing member 38 is secured to the upper surface of the upper end plate 12 by means of the metallized portion 34 to support the stationary contact rod 16. Each of the auxiliary sealing members is made of a metal, such as Cu or Fe which is plastically deformable by the thermal stress generated by the slow cooling after brazing.

A shielding member C comprises a first main arc-shield 56 mounted on the stationary contact rod 16, a first auxiliary shield 58 provided coaxially with respect to the first main arc-shield 56, a second main arc-shield 60 mounte on a movable contact rod 20 and a second auxiliary shield 62 provided coaxially with respect to the second main arc-shield 60. The first main arc-shield 56 comprises a first tubular portion 56*a* fixed to the lower rod portion 16*d* and secured to a stationary electrical contact 18, a ring-shaped flat portion 56*b* formed integrally with the first tubular portion 56*a* and a second tubular portion 56*c* formed integrally with the flat portion 56*b* and directed toward the upper end plate 12. The second main arc-shield 60 is formed by a first tubular portion 60*a* fitted to the movable contact rod 20 and fastened to a movable electrical contact 22, a ring-shaped flat portion 60*b* formed integrally with the first tubular portion 60*a* and a second tubular portion 60*c* formed integrally with the flat portion 60*b* and directed toward the lower end plate 14.

The first auxiliary shield 58 includes a first tubular portion 58*a* having an outer diameter smaller than that of the first main arc-shield, a first flange portion 58*b* extending outwardly from the first tubular portion 58*a*, a second tubular portion 58*c* formed integrally with an outer edge of the first flange portion 58*b*, a second flange portion 58*d* extending outwardly from the second tubular portion 58*c* and having an outer diameter larger than that of the flange 10*e* of the housing 10 and a tubular projection 58*e* projecting from the outer edge of the second flange portion 58*d*. The second tubular portion 58*c* of the first auxiliary shield 58 is mounted on the housing 10 by inserting the second tubular portion 58*c* into the flange 10*e* of the housing 10 and engaging the second flange portion 58*d* to the outer surface of the flange 10*e* of the housing 10. The upper end plate 12 fits into the corner between the second flange portion 58*d* and the projection 58*e* of the second auxiliary shield 58. The second auxiliary shield 62 has a first tubular portion 62*a* having a smaller diameter than that of the second main arc-shield and coaxially located with the second main arc-shield 60, a flange portion 62*b* extending outwardly from the first tubular portion 62*a* and a second tubular portion 62*c* is inserted into the tubular portion 32*b* of the second sealing member 32 and is secured to the tubular portion 32*b* of the second auxiliary sealing member 32 by means of spot welding. The shielding member C is made of an austenitic stainless steel.

The movable electrical contact 22 has a circular recess 22*a*, a ring-shaped slot 22*b* and a ring-shaped contact segment 22*c* fixed into the slot 22*b*. The movable contact rod 20 is inserted and fixed in the circular slot 22*a* of the movable electrical contact 22. The movable contact rod 20 is movably secured to the lower end plate 14 by means of the hermetic seal means G including the bellows 40 mounted on the movable contact rod 20, brazing an upper end 40*b* of the bellows. The lower end 40*a* is fixed to an inner surface 14 by means of the metallized portion 34. Accordingly, the sealing performance is enhanced, because the mechanical strength of sealing is increased.

Referring now to the material of each component of the vacuum interrupter, the housing 10 is made of a nonmagnetic metallic material in the form of an austenitic stainless steel having high mechanical strength. Each of the upper and lower end plates 12 and 14 is made of inorganic insulating material such as ceramics or a crystallized glass. Metallized portions 34 are made of metal alloy obtained by adding Mo or Mn to Ti (Mn-Ti alloy or Mo-Mn-Ti alloy) having the same coefficient of thermal expansion as that of the end plates 12 and 14, having a brazing temperature between 500° C. and 1050° C. The stationary contact rod 16 and the movable contact rod 20 are made of Cu having a brazing temperature between 500° C. and 1050° C. The electrical contacts 18 and 22 are made of an alloy including Cu. The shielding member C is made of a nonmagnetic material in the form of an austenitic stainless steel. The bellows 40 is made of an austenitic stainless steel. Each of the first auxiliary sealing member 30 and the second auxiliary sealing member 32 is made of plastically deformable material in the form of Cu which is deformed by the thermal stress generated between the metallic housing 10 and the end plates 12 and 14 during slow cooling after the brazing and which is employed to enhance the sealing connection between the metallic housing 10 and the upper and lower end plates 12 and 14 having different coefficients of thermal expansion from that of the housing 10. The auxiliary sealing members 30 and 32 can be made of Fe which is also plastically deformed by the thermal stress during cooling after brazing. Further, the auxiliary sealing members 30 and 32 can be made of Fe-Ni-Co alloy or Fe-Ni alloy, which has approximately the same coefficient of thermal expansion as that of the end plates 12 and 14, in case the housing 10 is made of Cu or Fe which is deformed by the thermal stress generated during slow cooling after the brazing. The third auxiliary sealing member 38 is made of Cu which is also deformed by the thermal stress generated by the difference between the coefficients of thermal expansion of the upper end plate 12 and the stationary contact rod 16. Further, the third auxiliary sealing member 38 can be made of Fe-Ni-Co alloy or the Fe-Ni alloy, as in the case of the first and second auxiliary sealing members 30 and 32. Additionally, the shielding member C can be made of the inexpensive Fe when the vacuum interrupter is employed to the relatively low current and low voltage power system.

Figure 2:
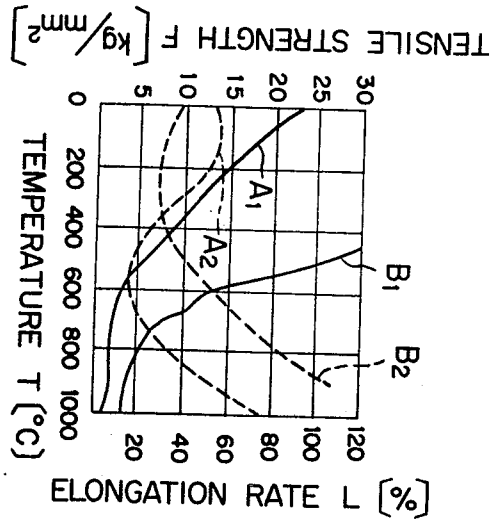
FIG. 2 is a graph showing characteristics of metallic materials employed in the vacuum interrupter of the present invention.

A method of manufacturing a vacuum interrupter according to the first embodiment of the present invention is now described in conjunction with FIGS. 1 and 2 of the accompanying drawings.

The vacuum interrupter is of a temporary construction as shown in FIG. 1. The temporarily constructed vacuum interrupter is heated in a vacuum furnace below a melting point of brazing materials for degassing. The furnace temperature is raised to a brazing temperature range 900° C. and 1050° C. at a pressure less than $10^{-5}$ torr in order to melt the brazing material and hermetically seal the brazing portion of the vacuum envelope of the vacuum interrupter. Thereafter the temperature of the furnace is decreased to a predetermined value for plastic deformation of the auxiliary sealing members and is held constant for a predetermined time interval. The temperature of the furnace is further decreased to the room temperature.

FIG. 2 shows the thermal characteristics of the tensile strength F and the elongation rate L of Cu and Fe, with respect to to the temperature T. In FIG. 2, a curve $A_1$ shows the tensile strength of the Cu with respect to the temperature, and a curve $B_1$ designates the tensile strength of the Fe with respect to the temperature. Further, a curve $A_2$ shows the elongation rate of Cu, and a curve $B_2$ shows the elongation rate of Fe with respect to the temperature. As is shown by the curves $A_1$, $B_1$ and $A_2$, $B_2$ of FIG. 2, the tensile strength of the material made of Cu decreases with the increment of temperature, and the elongation rate decreases and then increases with the increment of the temperature. Accordingly, it is appreciated that the plastic deformability is performed due to thermal stress generated due to the difference between the coefficients of thermal expansion of the auxiliary sealing member and the end plate during brazing and thereby the sealing of the junctions of the envelope is secured and the residual thermal stress is very small, because the tensile strength of the auxiliary sealing members made of Cu or Fe is very small compared with that of insulating end plates 12 and 14 made of the inorganic insulating materials such as the ceramics or the glass, when the auxiliary sealing members are brazed to housing 10 and end plates 12 and 14 at a high temperature less than 900° C. Accordingly, the high sealing performance and the high mechanical strength of the envelope are obtained by employing the auxiliary sealing member made of Cu, Fe, Fe-Ni-Co alloy or Fe-Ni alloy, in spite of the fact that the coefficients of the thermal expansion of the end plates 12 and 14 made of the inorganic insulating material in the form of ceramics differ from that of the housing 10 made of the metallic material such as the austenitic stainless steel, Cu or Fe. It is considered that the high sealing performance between the end plates 12 and 14 and the auxiliary sealing member is obtained when the housing 10 is made of Fe, because the coefficient of thermal expansion of the Fe is smaller than that of the Cu in spite of the fact that tensile strength of the Fe with respect to the temperature is larger than that of Cu as is shown in FIG. 2 and that the creep strain rate of Fe is smaller than that of Cu, under the predetermined temperature. Further, the high sealing performance between the end plate 14 and the bellows 40 can be obtained due to the plastic deformation thereof, since the thickness of the bellows 40 is very small (about 0.1–0.2 mm) and the thermal stress thereof is smaller than that of the lower end plate 14.

From the foregoing description, it will be appreciated that the following advantages can be achieved in the first embodiment of the vacuum interrupter according to the present invention:

Since the auxiliary sealing members which are deformable due to the thermal stress generated in cooling after the brazing are employed to connect the end plates made of insulating materials to the metallic materials in the form of the housing and the stationary contact rod, the sealing performance of the vacuum interrupter is extremely enhanced by the aid of the auxiliary sealing members.

The sealing between the components of the vacuum interrupter and the removal of gas generated in brazing is simultaneously carried out by heating at a temperature below the melting point of brazing material for degassing in vacuum heating furnace and by raising the furnace temperature range between 900° C. and 1050° C. at a pressure less than $10^{-5}$ torr in order to melt said brazing material and hermetically seal the brazing portion of the vacuum envelope of the vacuum interrupter.

In accordance with the vacuum interrupter of the first embodiment, since each of the auxiliary sealing members is provided with at least one curved portion, the impact force applied to the housing during opening and closing operation of the vacuum interrupter contacts is absorbed by the curved portion of the auxiliary member; similarly, thermal stress is absorbed by the curved portion. Since mechanical stress and thermal stress are eliminated, the diameter of the housing can be increased inexpensively and easily.

Figure 3:
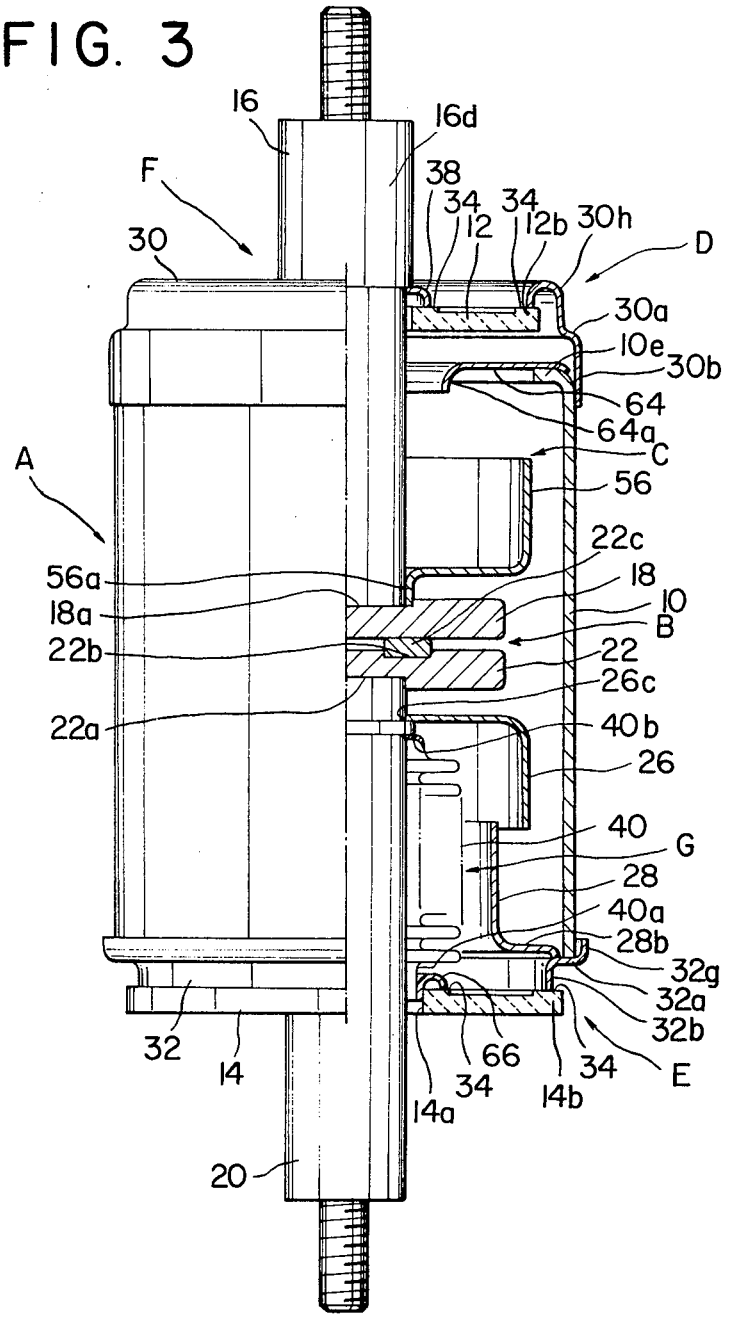
FIG. 3 is a partial cross sectional view of another embodiment of a vacuum interrupter according to the present invention.

FIG. 3 designates a second embodiment of the vacuum interrupter according to the present invention. As is shown in FIG. 3, a shielding member C includes an approximately disc-shaped first auxiliary shield 64 having an inner curved portion 64*a* which has a smaller diameter than that of the flange 10*e* of housing 10. The first auxiliary shield 64 is made of an austenitic stainless steel and is fixed to the flange portion 10*e* by brazing. A first end portion of the housing 10 is inserted into a tubular portion 30*b* of the first auxiliary sealing member 30 to form a surface-to-surface sealing portion. The second auxiliary shield 28 has a ring-shaped flange portion 28*b* affixed to a second auxiliary sealing member 32 of second sealing means E.

The second auxiliary sealing member 32 of the second sealing means E has a flange portion 32*a*, a first tubular portion 32*b* formed integrally with the flange portion 32*a* and a circular projection 32*g* projecting from the outer edge of the flange portion 32*a* and having a larger diameter than the housing 10. One end of the tubular portion 32*a* is affixed to the upper surface of a lower end plate 14 by means of a metallized portion 34. A second end portion of the housing 10 is secured to the flange portion 32*a* of the second auxiliary sealing member 32 to form the second sealing means E. An end surface of the second end portion of the housing 10 is secured to a surface of the flange portion 32*a* of the second auxiliary sealing member 32 to form a surface-to-surface sealing portion.

Hermetic seal means G comprises a bellows 40, an upper end 40*b* which is secured to a movable contact rod 20 and a lower end 40*a* which is inserted into an aperture 14*a* provided in the central portion of the disc-shaped lower end plate 14 and brazed to a fourth auxiliary sealing member 66. The fourth auxiliary sealing member 66 is made of a metallic material such as Cu or Fe and is U-shaped. An end of the fourth auxiliary sealing member 66 is secured to a metallized portion 34 provided on a ring-shaped projection which is fixed on the inner surface of the lower end plate 14 near the aperture 14*a* by brazing. In accordance with the vacuum interrupter shown in FIG. 3, the same advantages as those of FIG. 1 can be achieved.

Figure 4:
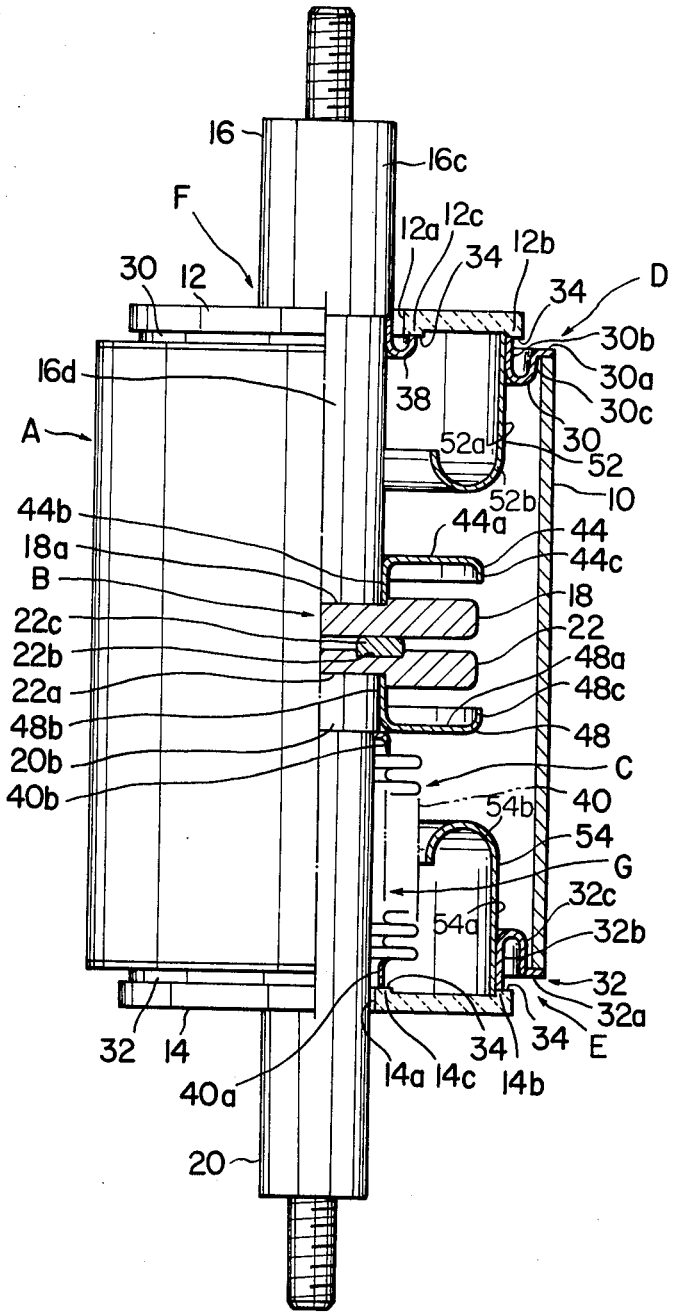
FIG. 4 is a cross sectional view of another embodiment of a vacuum interrupter according to the present invention.

FIG. 4 shows a third embodiment of the vacuum interrupter according to the present invention. In the vacuum interrupter shown in FIG. 4, a first sealing means D comprises a first end portion of the housing 10, a first auxiliary sealing member 30 having a ring-shaped flange portion 30*a*, a tubular portion 30*b* having a diameter smaller than that of the flange portion 30*a*, a curved portion 30*c* formed integrally with the flange portion 30*a* and the tubular portion 30*b*, and an end of a projection 12*b* which is secured to an end of the tubular portion 30*b* of the first auxiliary sealing member 30. An end surface of a first end portion of the housing 10 is secured to a surface of the ring-shaped flange portion 30*a* to form a surface-to-surface sealing portion. Sealing means E is comprised similar to that of the second sealing means E of the vacuum interrupter shown in FIG. 1.

Supporting means F for supporting and securing hermetically a stationary contact rod 16 includes a U-shaped third auxiliary sealing member 38 for connecting a stationary contact rod 16 in a sealed manner to an inner surface of the upper end plate 12. A shielding member C includes a first main arc-shield 44 mounted on the stationary contact rod 16, a first auxiliary shield 52 fixed to the upper end plate 12 and the first auxiliary sealing member 30, a second main arc-shield 48 secured to the movable contact rod 20 and a second auxiliary shield 54 fixed to the lower end plate 14 and the second auxiliary sealing member 32. The first main arc-shield 44 has a disc-shaped flat portion 44*a* having approximately the same diameter as that of the stationary electrical contact 18, a tubular portion 44*b* formed integrally with the flat portion 44*a* and a curved portion 44*c* curved rectangularly from the outer edge of the flat portion 44*a*. The tubular portion 44*b* of the first main arc-shield 44 is fitted to the stationary contact rod 16. A first auxiliary shield 52 has a tubular portion 52*a* and a curved portion 52*b*. The tubular portion 52*a* is secured to the first auxiliary sealing member 30 by spot welding. A second main arc-shield 48 comprises, similar to the first main arc-shield 44, a circular flat portion 48*a*, a tubular portion 48*b* and a curved portion 48*c*. The tubular portion 48*b* is fitted to a movable contact rod 20. The second auxiliary shield 54 has a tubular portion 54*a* and a curved portion 54*b*. An open end of the shield 54*a* is secured to the second auxiliary sealing member 32 by spot welding.

The stationary contact rod 16 comprises an upper rod portion 16*c* and a lower rod portion 16*d* whose radius is smaller than that of the upper rod portion 16*c*. The third sealing member 38 is inserted along the edges of the central aperture 12*a* of the upper end plate 12, the bottom of upper rod portion 16*c* and the upper end of the lower rod portion 16*d*. The lower rod portion 16*d* is inserted into the envelope A through the aperture 12*a* of the upper end plate 12 and the stationary contact rod 16 is supported to the end plate 12 by the upper rod portion 16*c*. This structure and a U-shaped third auxiliary sealing member 38 form the first securing means F.

Figure 5:
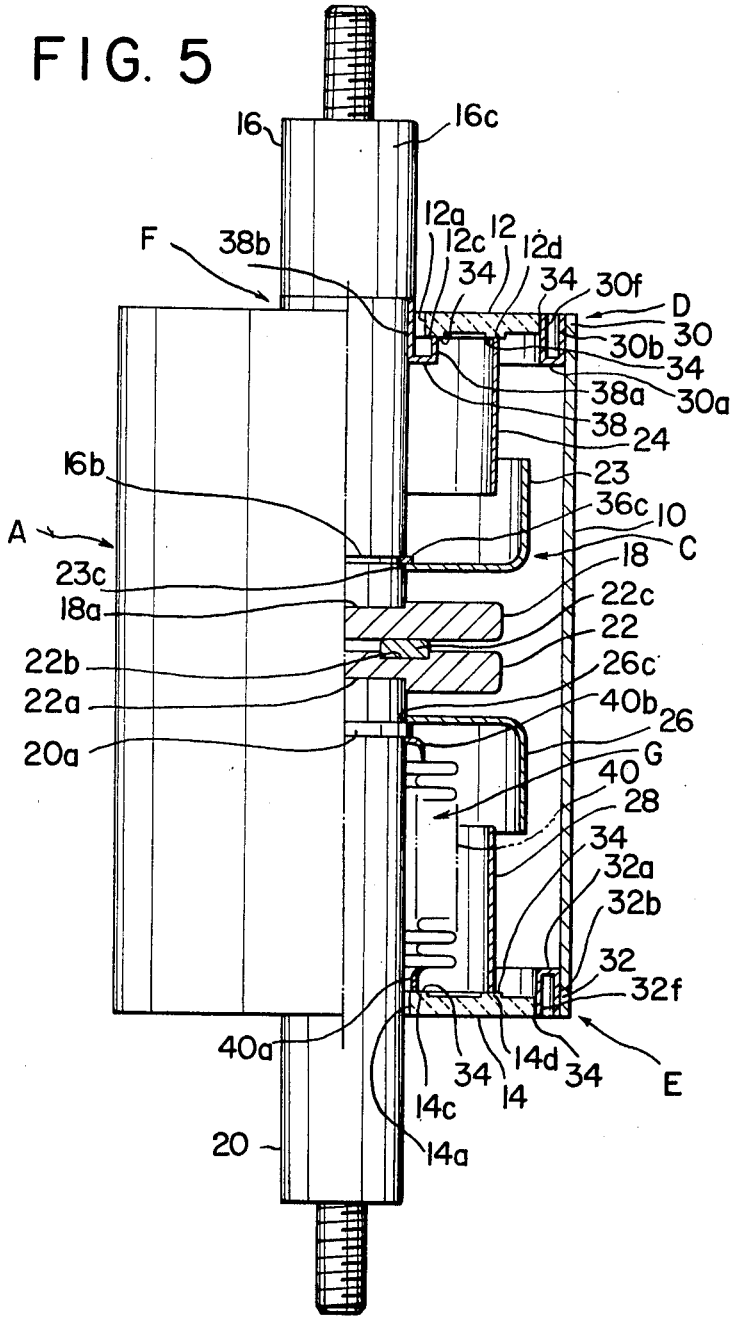
FIG. 5 is a partial cross sectional view showing another embodiment of the present invention.

FIG. 5 shows a fourth embodiment of the vacuum interrupter according to the present invention. In the interrupter shown in FIG. 5, a first auxiliary sealing member 30 of the first sealing means D comprises a first tubular portion 30*b* and a second tubular portion 30*f* with a diameter smaller than that of the first tubular portion 30*b* and formed integrally with the first tubular portion by way of a flange portion 30*a*. The first tubular portion 30*b* is fitted into the housing 10 and secured to the inner surface of the housing by means of brazing to form a surface-to-surface sealing portion. The peripheral surface of an upper end plate 12 is fitted into the second tubular portion 30*f* and secured by means of brazing to form a surface-to-surface sealing portion of the first sealing means D. A second sealing means E includes a second auxiliary sealing member 32 having a first tubular portion 32*b*, a flange portion 32*a*, and a second tubular portion 32*f* formed integrally with the first tubular portion 32*b* via a flange portion 32*a*, and is secured similarly to the first sealing means D.

The shielding member C comprises a cup-shaped first main arc-shield 23 mounted on the stationary contact rod 16, a tubular-shaped first auxiliary shield 24 fixed to an inner surface of the upper end plate 12 by means of a metallized portion 34, and a brazing material, a second main arc-shield 26 mounted on a flange 20*a* of the movable contact rod 20 so as to be directed toward the lower end plate 14 and a tubular-shaped second auxiliary shield 28 fixed to an inner surface of the lower end plate 14 so as to be located coaxially with respect to the second main arc-shield 26. Since the auxiliary shields 24 and 28 are, respectively, secured to the end plates 12 and 14, the voltage potential is maintained to an intermediate value between that of the stationary contact rod 16 and that of the housing 10 and thereby the insulating strength within the envelope A is enhanced.

Figure 6:
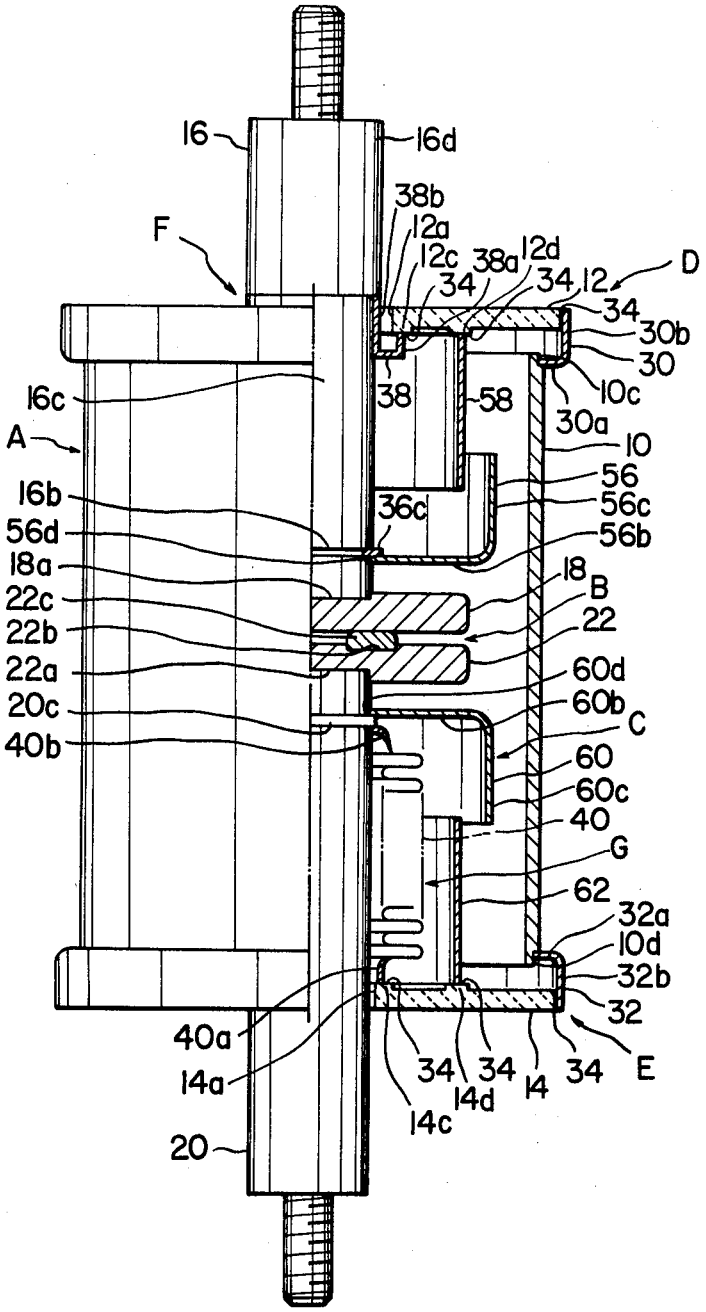
FIG. 6 is a partial cross sectional view of another embodiment of a vacuum interrupter according to the present invention.

FIG. 6 shows a fifth embodiment of the vacuum interrupter of the present invention.

In the interrupter of FIG. 6, a first auxiliary sealing member 30 has a flange 30*a* and a tubular portion 30*b*. The inner end of the flange 30*a* is secured to an outer stepped portion 10*c* of the housing 10, and an upper end plate 12 is fitted into and secured to the tubular portion 30*b* sandwiching therebetween a metalized portion 34, to form first sealing means D. An inner surface of the tubular portion 30*b* is secured to an outer peripheral surface of the upper end plate 12 to form a surface-to-surface sealing portion. Second sealing means E includes a second auxiliary sealing member 32 which comprises a flange 32*a* and a tubular portion 32*b*, and which is formed as described for the first sealing means D, and a surface-to-surface sealing portion is formed between an inner surface of the tubular portion 32*b* and an outer peripheral surface of the lower end plate 14.

In accordance with the vacuum interrupter of the fifth embodiment, the mechanical strength against the mechanical shock generated in the interrupting operation is greatly increased, since the sealing portions are provided with curved stress-relieving portions.

Figure 7:
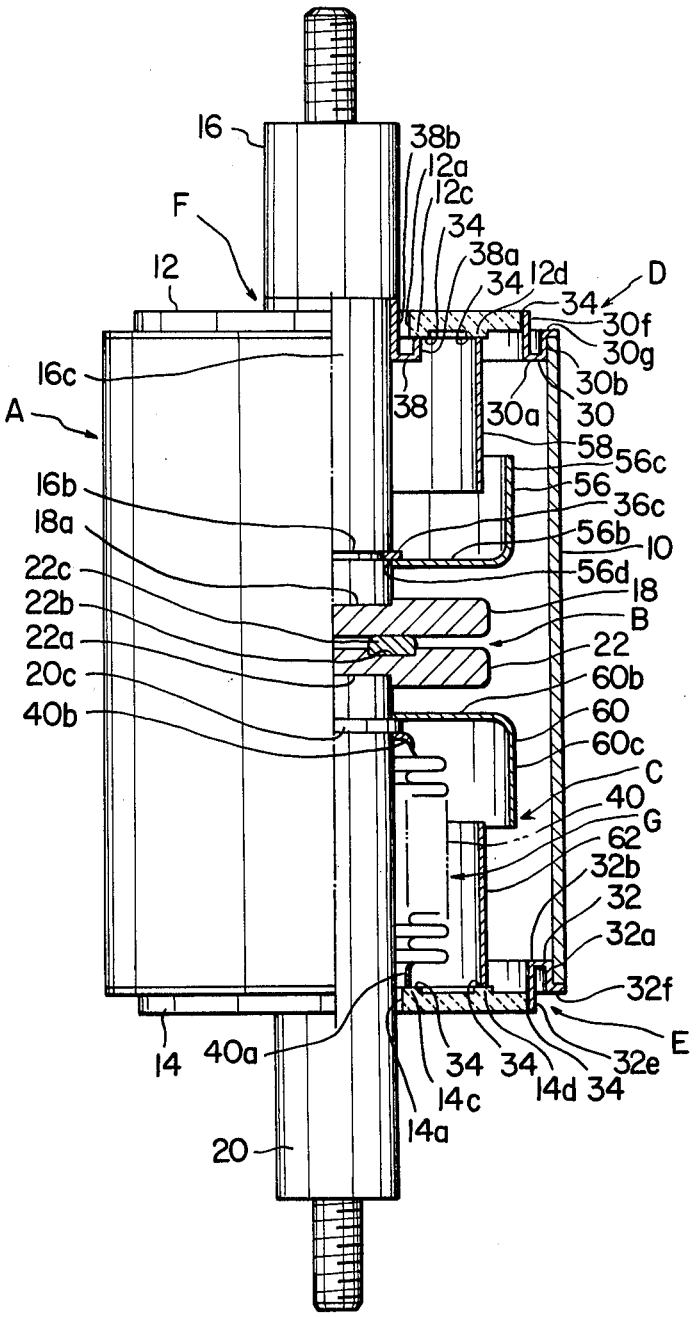
FIG. 7 is a partial cross sectional view of further embodiment of a vacuum interrupter according to the present invention.

FIG. 7 shows a sixth embodiment of the vacuum interrupter in accordance with the present invention. In the vacuum interrupter of FIG. 7, a first auxiliary sealing means D includes a flange portion 30*a*, a first tubular portion 30*b*, a second flange portion 30*f* all which are formed integrally. The first tubular portion 30*b* fits sealingly within the housing 10, and the second flange 30g is secured to an end surface of a first end portion of the housing 10. An outer peripherial surface of end plate 12 is fitted into the second tubular portion 30f, sandwiching therebetween a metallized portion 34, to form the first seaing means D. The first sealing means D is provided with surface-to-surface sealing portions.

A second sealing means E includes a second auxiliary sealing member 32 formed similarly to the first auxiliary sealing member 30 and is constructed similar to the first sealing means D.

Each of the vacuum interrupters shown in FIGS. 5 to 7 is made as follows. Firstly, each of the stationary portion, the movable portion and the housing portion is constructed by heating at a temperature lower than the melting point of the brazing material for degassing in high vacuum heating furnace. The furnace temperature is raised to a brazing temperature range between 900° C. and 1050° C. at a pressure less than $10^{-5}$ torr in order to melt the brazing material and hermetically seal the brazing portion of the vacuum envelope of the vacuum interrupter, and then said furnace is cooled to the room temperature to form the stationary portion, the movable portion and the housing portion. The temporary construction of the vacuum interrupter is carried out by means of the stationary portion, the movable portion and the housing portion. The temporarily constructed vacuum interrupter is heated at a temperature below the melting point of brazing material for degassing in a high vacuum heating furnace. The furnace temperature is raised to a brazing temperature at a pressure less than $10^{-5}$ torr in order to melt the brazing material and hermetically seal the brazing portions of the vacuum envelope, and then the furnace is cooled to the room temperature.

In view of the above, it will be seen that the several objects of the invention are achieved and other advantageous results are attained.

While preferred embodiments of the invention have been shown and described, it will be apparent to those skilled in the art that modifications can be made within the scope of which is defined in the appended claims. Accordingly, the foregoing embodiments are to be considered illustrative, rather than restricting, of the invention and those modifications which come within the meaning and range of equivalency of the claims are to be included herein.

What is claimed is:

1. A vacuum interrupter comprising in combination:

an envelope including a cylindrical housing made of stainless steel and having a first end portion and a second end portion, a disc-shaped upper end plate made of ceramic insulating material having an aperture in the center portion thereof and a disc-shaped lower end plate made of a ceramic insulating material having an aperture in the center portion thereof;

an electrical contact member including a stationary contact rod inserted into said envelope through said aperture of the upper end plate, a stationary electrical contact secured to said stationary contact rod, a movable contact rod inserted into said envelope through said aperture of the lower end plate and a movable electrical contact secured to said movable contact rod;

shielding means for shielding an inner surface of said envelope;

first sealing means including a first auxiliary sealing member made of a plastically deformable metallic material which is deformable by the thermal stress generated during a cooling process after brazing and a metallized portion provided between said first auxiliary sealing member and said upper end plate and for sealing hermetically the upper end plate to said first end portion of said housing by plastically deforming said first auxiliary sealing member after brazing the first sealing member to said housing;

second sealing means including a second auxiliary sealing member made of a plastically deformable metallic material which is deformable by the thermal stress generated during a cooling process after brazing and a metallized portion provided between said second auxiliary sealing member and said lower end plate and for sealing hermetically said lower end plate to said second end portion of said housing by plastically deforming said second auxiliary sealing member after brazing the second sealing member to said lower end plate and said housing;

first supporting means including a third auxiliary sealing member made of a plastically deformable metallic material which is deformable by the thermal stress generated during a cooling process after brazing and a metallized portion provided between said upper end plate and said third auxiliary sealing member and for supporting and securing hermetically said stationary contact rod to said upper end plate by plastically deforming said third auxiliary sealing member after brazing the third sealing member to said upper end plate and said stationary contact rod;

said first, second and third auxiliary sealing members having different coefficients of thermal expansion from those of said upper and lower end plates;

hermetic seal means for sealing movably and hermetically said movable contact rod to said lower end plate including a bellows for securing said movable contact rod to said lower end plate and a metallized portion provided between said lower end plate and said bellows; and stress absorbing means for absorbing thermal stress and mechanical stress and provided in at least one of said first and second auxiliary sealing members, each sealing member having a flange portion and a tubular portion and at least one curved portion, said first sealing means having at least one surface-to-surface sealing portion provided between a vacuum side surface of one end portion of said first auxiliary sealing member and the first end portion of said housing or an outer end portion of said upper end plate, said second sealing means having at least one surface-to-surface sealing portion provided between a vacuum side surface of one end portion of said second auxiliary sealing member and the second end portion of said housing or an outer end portion of said lower end plate.

2. A vacuum interrupter as claimed in claim 1, wherein said first sealing means comprises said first end portion of the housing, said first auxiliary sealing member secured to said end portion of said housing and an outer peripheral surface portion of said upper end plate secured to a tubular surface portion of said first auxiliary sealing member via the metallized portion.

3. A vacuum interrupter as claimed in claim 1, wherein said second sealing means comprises said second end portion of the housing, said second auxiliary sealing member secured to said second end portion of the housing and an outer peripheral surface portion of said lower end plate secured to a tubular surface portion of said second sealing member via the metallized portion.

4. A vacuum interrupter as claimed in claim 1, wherein said first and second auxiliary sealing members of the first and second sealing means are made of Cu.

5. A vacuum interrupter as claimed in claim 1, wherein said first and second auxiliary members of said first and second sealing means are made of Fe.

6. A vacuum interrupter as claimed in claim 1, wherein said third auxiliary sealing member is made of Cu.

7. A vacuum interrupter as claimed in claim 1 wherein said third auxiliary sealing member of said first supporting means is made of Fe.

8. A vacuum interrupter as claimed in claim 1, wherein said third auxiliary sealing member of the first supporting means comprises a first tubular surface portion secured to an outer surface of said stationary contact rod, a ring-shaped flat portion formed integrally with said first tubular portion and a second tubular portion formed integrally with said flat portion and secured to an inner surface of said upper end plate by means of said metallized portion.

9. A vacuum interrupter as claimed in claim 1, wherein said first auxiliary sealing member comprises a first tubular surface portion secured to an inner surface of said first end portion of the housing and a second tubular surface portion secured to an outer peripheral surface of the upper end plate.

10. A vacuum interrupter as claimed in claim 9, wherein said first auxiliary sealing member further houses a flange surface portion secured to an end of said housing.

11. A vacuum interrupter as claimed in claims 2 or 3, wherein each of said first and second auxiliary sealing members comprises a first tubular portion secured to an outer peripheral surface of respective end plate and a flange portion of which an end portion is secured to a stepped portion provided in an outer circumferential surface of respective end portion of said housing.

12. A vacuum interrupter as claimed in claim 1, wherein said second auxiliary sealing member houses a flange surface portion secured to said second end portion of the housing.

13. A vacuum interrupter as claimed in claim 1, wherein said first auxiliary sealing member comprises a tubular inner surface portion secured to an outer circumferential surface of said housing, a flange portion inwardly extending from said tubular portion and a stress absorbing portion curled inwardly from said flange portion and secured to an upper end surface of said upper end plate.

14. A vacuum interrupter as claimed in claim 1, wherein said second auxiliary sealing member comprises a flange portion secured to said second end portion of said housing and a tubular portion having a smaller diameter than that of said flange portion formed integrally with said flange portion and secured to a ring-shaped projection of said lower end plate.

15. A vacuum interrupter as claimed in claim 1, wherein said bellows of which one end is secured to said movable contact rod and of which another end portion is inserted into said aperture of said lower end plate and a fourth auxiliary sealing member connecting said another end portion of the bellows to said lower end plate and which is deformable by the thermal stress generated in a cooling process after brazing.

16. A vacuum interrupter as claimed in claim 1, wherein said first supporting means has at least one surface-to-surface sealing portion provided between a vacuum side surface of one end of said third auxiliary sealing member and said stationary contact rod and an inner end portion of said upper end plate.

17. A vacuum interrupter as claimed in claim 1, wherein said second auxiliary sealing member has a first tubular surface portion secured to an inner surface of said second end portion of the housing and a second tubular surface portion secured to an outer circumferential surface of the lower end plate.

* * * * *